US006046107A

United States Patent [19]

Lee et al.

[11] Patent Number: 6,046,107

[45] Date of Patent: Apr. 4, 2000

[54] ELECTROLESS COPPER EMPLOYING HYPOPHOSPHITE AS A REDUCING AGENT

[75] Inventors: Chwan-Ying Lee, Tainan; Tzuen-Hsi Huang, Tou Liu, both of Taiwan

[73] Assignee: Industrial Technology Research Institute, Hsin-Chu, Taiwan

[21] Appl. No.: 09/213,458

[22] Filed: Dec. 17, 1998

[51] Int. Cl.[7] ..... H01L 21/44; B05D 5/12

[52] U.S. Cl. ..... 438/687; 427/97; 427/98; 427/304; 427/305; 427/306; 427/437; 427/443.1; 438/675

[58] Field of Search ..... 106/1.22–1.28; 427/97, 98, 304–306, 437, 443.1; 438/687, 675

[56] References Cited

U.S. PATENT DOCUMENTS

| | | | |
|---|---|---|---|
| 4,265,943 | 5/1981 | Goldstein et al. | 427/305 |
| 4,279,948 | 7/1981 | Kukanskis et al. | 427/305 |
| 4,659,587 | 4/1987 | Imura et al. | 427/35 |
| 5,075,259 | 12/1991 | Moran | 437/230 |
| 5,169,680 | 12/1992 | Ting et al. | 427/96 |
| 5,242,861 | 9/1993 | Inaba | 437/190 |
| 5,318,803 | 6/1994 | Bickford et al. | 427/306 |
| 5,443,865 | 8/1995 | Tisdale et al. | 427/304 |
| 5,538,616 | 7/1996 | Arai | 205/126 |
| 5,562,760 | 10/1996 | Ballard et al. | 106/1.24 |
| 5,660,883 | 8/1997 | Omura | 427/304 |
| 5,674,787 | 10/1997 | Zhao et al. | 437/230 |

*Primary Examiner*—Brian K. Talbot
*Attorney, Agent, or Firm*—George O. Saile; Stephen B. Ackerman; William J. Stoffel

[57] ABSTRACT

Method and baths for electroless depositing Cu on a semiconductor chip using four preferred Cu electroless baths. All four preferred electroless baths use hypophosphite as a reducing agent. The 4 baths use the following mediators (1) Nickel sulfate, (2) Pd Sulfate (3) Co Sulfate (4) Fe Sulfite, and complexing agents (Na Citrite, Boric Acid, Ammonium Sulfite). The baths can operate at a pH between 8 and 10. The invention forms high purity Cu interconnects having adequate step coverage to form in a hole having an aspect ratio greater than 2.7 to 1.

7 Claims, 2 Drawing Sheets

ELECTROLESS COPPER EMPLOYING HYPOPHOSPHITE AS A REDUCING AGENT

SUMMARY OF THE INVENTION

1). Field of the Invention

This invention relates generally the electroless deposition of metal lines and interconnections in semiconductor devices and more particularly to electroless baths and methods using a hypophosphite reducing agent to form metal lines in semiconductor chips.

2). Description of the Prior Art

In the manufacture of devices on a semiconductor wafer, it is now the practice to fabricate multiple levels of conductive (typically metal) layers above a substrate. The multiple metallization layers are employed in order to accommodate higher densities as device dimensions shrink well below one micron design rules. Thus, semiconductor "chips" having three and four levels of metallization are becoming more prevalent as device geometries shrink to sub-micron levels.

One common metal used for forming metal lines (also referred to as wiring) on a wafer is aluminum. Aluminum is used because it is relatively inexpensive compared to other conductive materials, it has low resistivity and is also relatively easy to etch. Aluminum is also used as a material for forming interconnections in vias to connect the different metal layers. However, as the size of via/contact holes is scaled down to a sub-micron region, the step coverage problem appears, which has led to reliability problems when using aluminum to form the interconnection between different wiring layers. The poor step coverage in the sub-micron via/contact holes results in high current density and enhances the electromigration.

One approach to providing improved interconnection paths in the vias is to form completely filled plugs by utilizing metals, such as tungsten. Thus, many semiconductor devices fabricated utilizing the current state of VLSI (Very Large Scale Integration) technology employ the use of aluminum for the wiring and tungsten plugs for providing the interconnection between the different levels of wiring. However, there are disadvantages of using tungsten as well. Mostly, tungsten processes are complicated and appreciably expensive. Tungsten also has high resistivity.

One material which has received considerable attention as a replacement material for VLSI interconnect metallizations is copper. Since copper has better electromigration property and lower resistivity than aluminum, it is a more preferred material for wiring and plugs than aluminum. In addition, copper has more improved electrical properties over tungsten, making copper a desirable metal for use as plugs. However, one serious disadvantage of using copper metallization is that it is difficult to etch. Thus, where it was relatively easy to etch aluminum or tungsten after depositing them to form lines or via plugs (both wiring and plugs are referred to as interconnects), substantial additional cost and time are now required to etch copper. Accordingly, one practice has been to utilize chemical-mechanical polishing (CMP) techniques to polish away the unwanted copper material.

To replace the tungsten and aluminum plugs with copper plugs in VLSI (or ULSI) manufacturing, another important factor to consider is the process cost. The technique of selectively depositing copper within the via holes to form the plugs is attractive, because it eliminates the polishing (CMP) step. One technique of selectively depositing copper, as well as other metals, is the use of electroless deposition.

In comparison to other copper deposition techniques, electroless copper deposition is attractive due to the low processing cost and high quality of copper deposited. The equipment for performing electroless metal deposition are relatively less expensive, as compared to other semiconductor equipment for depositing metals, and the technique allows for batch processing of wafers. Thus, overall cost can be reduced by using electroless deposition. However, electroless deposition requires the activation of a surface in order to electrolessly deposit the metal, such as copper.

The use of an electroless plating bath for electrolessly depositing a metal, e.g., copper, onto a substrate, is now a common practice in the manufacture of a variety of electronic packaging substrates, such as printed circuit boards. Such an electroless plating bath conventionally includes: (1) water; (2) a soluble compound containing the metal to be deposited onto the substrate of interest; (3) a complexing agent for the corresponding metal ions, which serves to prevent chemical reduction of the metal ions in solution while permitting selective chemical reduction on a surface of the substrate; (4) a chemical reducing agent for the metal ions; (5) a buffer for controlling pH; and (6) small amounts of additives, such as bath stabilizers and surfactants.

The electroless plating baths used to deposit, for example, copper onto printed circuit board substrates conventionally include copper sulfate as the source of copper, ethylenediaminetetraacetic acid (EDTA) as the complexing agent and formaldehyde as the reducing agent. Obviously, the use of formaldehyde as a reducing agent in such baths is undesirable because it poses health and safety problems for human beings. Moreover, such baths can only operate at pH 11 or greater. But, this is considered undesirable because certain substrates, such as polyimide substrates, cannot withstand such high pHs, over the times and temperatures needed to achieve copper plating.

One attempt at overcoming the above-described drawbacks associated with conventional copper plating baths has involved the use of amino boranes, e.g., dimethylaminoborane, as reducing agents. While these reducing agents do not pose the health and safety problems that formaldehyde poses, their relatively high cost has limited their use to small volume, high end electronic packaging substrate products.

Yet another attempt at overcoming the above-described drawbacks has involved the use of hypophosphite ions (introduced into a copper plating bath as, for example, sodium hypophosphite) as the reducing agent. While hypophosphite is relatively innocuous, it has been found that when used as a reducing agent (in the absence of nickel or cobalt ions, discussed below), the corresponding deposition of copper stops after a very short period of time, with the thickness of the deposited copper being no more than about 1 micrometer. That is, while such a bath is initially autocatalytic in relation to the reduction of copper ions at a substrate surface, it quickly becomes non-autocatalytic. It is believed that this behavior is due to the incorporation of phosphorus (from the hypophosphite) into the substrate surface, which poisons the chemical reduction reaction at the substrate surface.

Significantly, as described in U.S. Pat. No. 4,265,943, issued to Goldstein et al on May 5, 1981, it has been found that the introduction of nickel ions or cobalt ions into an electroless copper plating bath using a hypophosphite reducing agent serves to overcome the above-described problem. That is, the presence of nickel ions or cobalt ions serves to convert the above-described non-autocatalytic copper-reduction reaction into one which is autocatalytic, resulting in continuous deposition of copper. However, if, for example, nickel ions are used, then it has been found by the present inventors that the resulting deposited copper invariably contains at least 3.63 atomic percent incorporated nickel, while if cobalt ions are used, then it has also been found by the present inventors that the resulting deposited copper invariably contains even more incorporated cobalt. In either event, such relatively large amounts of incorporated nickel or cobalt are unacceptable for many applications.

Typical electroless copper bath formulations will contain the following ingredients:

1. Copper salts: the preferred source of copper ion is copper sulphate (copper sulfate) or copper chloride.
2. Reducing agent: Formaldehyde was used as the reducing agent in the electroless Cu bath.
3. Alkaline hydroxide: The formaldehyde and hydroxide ions provide the reducing force necessary for the deposition of metallic copper.
4. Chelating agents—form copper complexes, prevent excess free Ni ion to decompose the solution (Monocarboxylic acids, dicarboxylic acids, ammonia, EDTA, Rochelle salts and etc.)
5. Stabilizer: prevent solution breakdown by shielding catalytically active nuclei. (Lead, tin arsenic, molybdenum, cadmium, thallium thiourea and so on) very small 1 or 2 ppm/liter
6. Accelerators: activate reducing agents and accelerate dep., (anions of some mono- and dicarboxylic acids, fluorides, borates) very small 1 or 2 ppm/l
7. Buffer: for longer term pH control.

Problems or Disadvantages with Conventional Baths

The inventor has identified the follow problems with present Cu electroless baths in semiconductor chip manufacturing:

EDTA is difficult to waste treat

Formaldehyde a carcinogen

Deposition operated at high pH Levels e.g., 13 to 14

Formaldehyde-based baths can not be used with most forms of polyimide or aqueous photoresist The importance of overcoming the various deficiencies noted above is evidenced by the extensive technological development directed to the subject, as documented by the relevant patent and technical literature. The closest and apparently more relevant technical developments in the patent literature can be gleaned by considering U.S. Pat. No. 5,242,861(Inaba) shows a method of depositing various metals for metalization.

U.S. Pat. No. 5,660,883(Omura) shows a method of electroless depositing Ni using Sodium Hypophoshite. See col. 7 and 8.

U.S. Pat. No. 5,674,787(Zho et al.) shows a selective Cu deposition process.

U.S. Pat. No. 5,169,680 (Ting) shows an electroless dep of Cu for a metallization.

U.S. Pat. No. 5,538,616(Arai) shows a method of electrolessly deposition Ni using Sodium Hypophosphite. See col. 2.

U.S. Pat. No. 5,443,856(Tisdale et al.) shows a method of electroless deposition of a metal (Cu, Ni, etc) using various seed layers.

U.S. Pat. No. 5,318,803(Bickford et al.) shows an electroless deposition methods using Pd seed layers.

U.S. Pat. No. 5,075,259(Moran) shows a method of electroless plating over suicides.

U.S. Pat. No. 4,659,587(Imura) shows an electroless Cu method using EDTA.

U.S. Pat. No. 4,279,948(Kukanskis et al.), U.S. Pat. No. 5,562,760(Ballard), U.S. Pat. No. 4,279,948(Kukanskis et al.) U.S. Pat. No. 4,265,943 (Goldstein) show various Cu electroless deposition techniques.

The present invention describes a technique of utilizing electroless metallization to selectively form copper plugs and wire layers.

SUMMARY OF THE INVENTION

It is an object of the present invention to provide a method for fabricating a metal lines and interconnects on a semiconductor chip using an Cu electroless deposition process using a hypophosphite reducing agent.

It is an object of the present invention to provide a method for fabricating a metal lines and interconnects on a semiconductor chip using an Cu electroless deposition process using hypophosphite reducing agent and mediators (i.e., (1) Nickel sulfate, (2) Pd Sulfite (3) Co Sulfate (4) Fe Sulfite and complexing agents (Na Citrite, Boric Acid, Ammonium Sulfite) at a PH range 8 to 10.

To accomplish the above objectives, the present invention provides a method of electroless depositing Cu on a semiconductor chip using 4 preferred Cu electroless baths. All baths use hypophosphite as a reducing agent. The 4 baths use the following mediators (1) Nickel sulfate, (2) Pd Sulfite (3) Co Sulfite (4) Fe Sulfite. and complexing agents (Na Citrite, Boric Acid, Ammonium Sulfite). The baths can operate at a pH between 8 and 10. The baths produce high purity Cu interconnects than conventional baths.

Benefits

Key features of the invention are:

Cu electroless depositions

Mediators hypophsoshite reducing agent 8 to 9 pH low temp

The invention has the advantages of:

using complexing agents that are easy to disposed of The prior art's EDTA is difficult to waste treat Using Hypophosphite as reducing agent. In contrast, Formaldhyde is a carcinogen

*Cu deposition at a low pH. In contrast, prior art deposition operated at high pH Levels e.g., 13 to 14

* Using Hypophosphite as reducing agent. In contrast, Formaldehyde-based baths can not be used with most forms of polyimide or aqueous photoresist.

The invention forms high purity Cu lines by utilizing selective electroless deposited in the fabrication of multi-level metallization VLSI integrated using the solutions of the invention.

The invention's electroless baths give special Cu metal deposition properties, e.g., high purity, high Cu deposition and long bath stability.

The present invention achieves these benefits in the context of known process technology. However, a further understanding of the nature and advantages of the present invention may be realized by reference to the latter portions of the specification.

BRIEF DESCRIPTION OF THE DRAWINGS

The features and advantages of a semiconductor device according to the present invention and further details of a process of fabricating such a semiconductor device in accordance with the present invention will be more clearly understood from the following description taken in conjunction with the accompanying drawings in which like reference numerals designate similar or corresponding elements, regions and portions and in which.

DETAILED DESCRIPTION OF THE PREFERRED EMBODIMENTS

Figure 1:
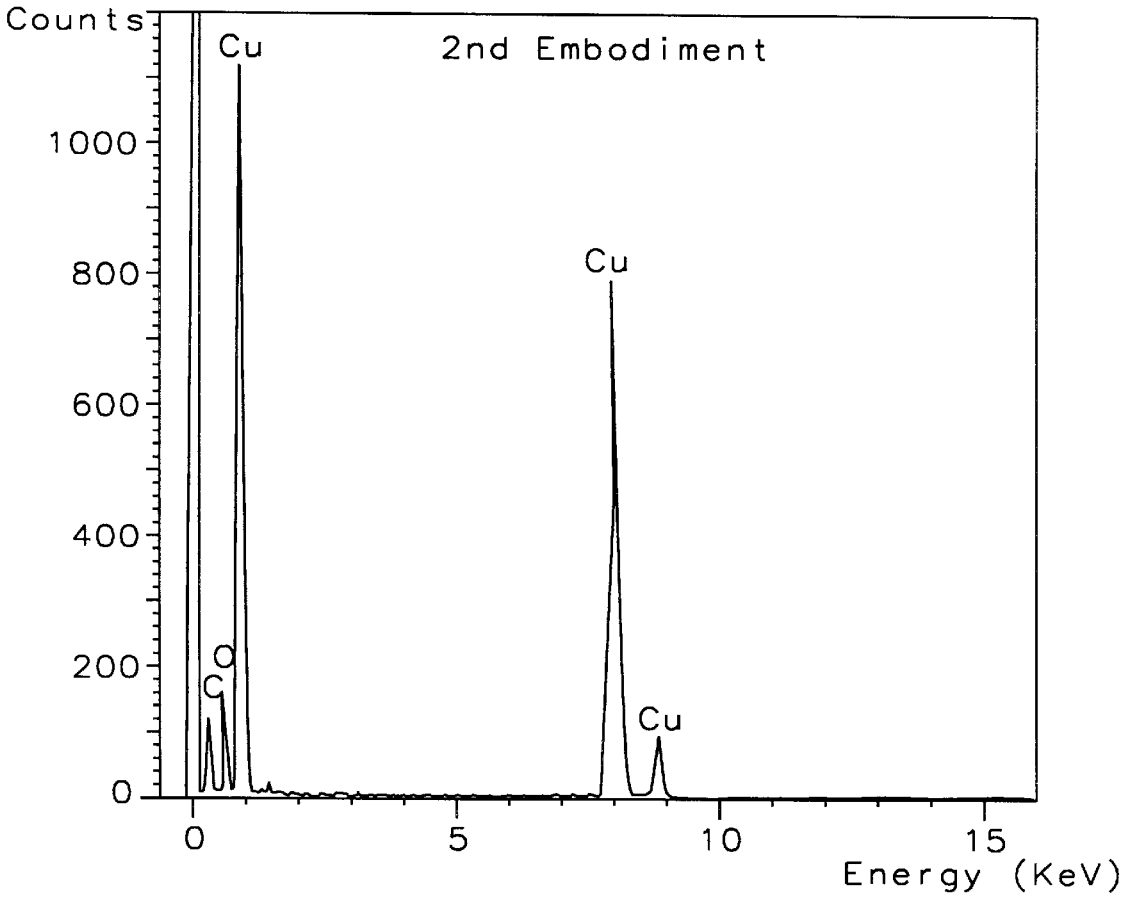
FIG. 1 is a spectrum analysis of a copper deposition formed using the 2nd embodiment's electroless deposition of the invention.

The present invention provides a method of electroless depositing a Cu layer over a semiconductor surface.

In the following description numerous specific details are set forth such as flow rates, pressure settings, thicknesses, etc., in order to provide a more thorough understanding of the present invention. It will be obvious, however, to one skilled in the art that the present invention may be practiced without these details. In other instances, well know process have not be described in detail in order to not unnecessarily obscure the present invention.

Description of the Preferred Surface and Activation Process Used With the Invention's Bath The Cu is preferably deposited on polysilicon, silicon, Aluminum, TiN, $TiSi_x$, Ti and Ni.

The surfaces are preferably activated using a Pd—containing activation solution.

Electroless Deposition Over A Semiconductor Surface

The invention has 4 embodiments of Cu electroless deposition baths that are environmentally safer and allow the used of more polyimide and aqueous photoresist layers than conventional EDTA and Formaldehyde baths. Importantly, the invention allows production of low resistncecopper interconnect/lines in half micron ULSI patterns having aspect ratio about 3:1 (e.g., between 2:1 and 4:1 and preferably greater than 2.7 to 1). Prior art techniques do not allow adequate step coverage of submicron via holes. The invention has 4 embodiments of Cu electroless baths to electroless deposit Cu over a first layer surface over a semiconductor surface.

The invention's 4 electroless Cu baths of the invention have the following important features:

(1) Cu main metal deposited, (2) hypophosphite is the reducing agent, (3) the specific mediator works well with (and is superior with) Cu and the hypophosphite reducing agent, (4) pH is between 8 and 9

(5) low temp is used. (temperature between 64 and 66° C.)

In addition to the features listed above the following ingredients can be substituted in to the invention's 4 electroless baths:

1. stabilizers: prevent solution breakdown by shielding catalytically active nuclei. (such as Lead, tin arsenic, molybdenum, cadmium, thallium thiourea and so on) very small 1 or 2 ppm/liter
2. Accelerators: activate reducing agents and accelerate dep, anions of some mono- and adicarboxylic acids, fluorides, borates) very small 1 or 2 ppm/l
3. Buffer: for longer term pH control.

1st Embodiment Electroless Cu—Ni—P Bath

The first embodiment of the invention is an Electroless Cu—Ni—P bath as shown below in the table:

TABLE

1st embodiment - Cu—Ni—P electroless bath composition

| Chemical | Low limit | Target | high limit |
|---|---|---|---|
| Copper sulphate | 23.2 mM | 24 mM | 24.8 mM |
| Sodium citrate.-chelating agent | 50 mM | 52 mM | 54 mM |
| Nickel sulphate-mediator in bath | 1.95 mM | 2 mM | 2.05 mM |
| Sodium hypophosphite | 140 mM | 150 mM | 160 mM |
| pH (maintained with NaOH) | 9.1 | 9.2 | 9.3 |
| Temperature | 64 | 65° C. | 66 |

NOTE:
mM = Milli Moles/liter

The metal layer electroless deposited by the bath of the 1st embodiment has a composition of about Cu=94 wt %, Ni=3 wt % and P=3 w %. (all elements preferably have limits +/−0.5%).

The resistance is about 3.11 micro-ohm-cm (e.g., between about 3.0 to 23.2 micro-ohm-cm). This compares to pure Cu which has a resistance of about 1.9 micro-ohm-cm

2nd Embodiment

The 2nd embodiment uses a Electroless Ni—Pd—P Solution. The process results in about 100 wt % Cu—Resistance about 25 micro ohms/cm.

TABLE

Electroless Ni—Pd—P solution for 2nd embodiment

| Chemical | Low Limit | target | High limit |
|---|---|---|---|
| Copper sulphate | 23.2 | 24 mM | 24.8 |
| Palladium sulphate | 0.012 mM | 0.0125 mM | 0.013 mM |
| Sodium hypophosphite | 90 mM | 100 mM | 110 mM |
| Boric acid | 135 mM | 150 mM | 165 mM |
| Tetramethylethylenediamine | 40 | 50 g/L | 60 mM |
| pH | 9.1 | 9.2 | 9.3 |
| Temp | 64 | 65° C. | 66 |

Note that the Tetramethylethylenediamine replaces Niacitate- but Na citrate can also be used with this bath.

FIG. 1 shows a Spectrum analysis of the copper deposited using the $2^{nd}$ embodiment of the invention. Below are the conditions of the deposition.

Spectrum 1 (Feb. 4, 1997 11:22)

TABLE $2^{nd}$ embodiment - Cu—Pd—P Solution

| | target |
|---|---|
| Palliadium Chloride | 0.0125 mM |
| Copper Sulphate | 24 mM |
| Sodium Citrate | 5:2 mM |
| Tetramethylethylenediamine | 50 g/L |
| Boric acid | 150 mM |
| pH | 9.2 |
| Temp. | 65° C. |

FIG. 1 show the high purity achievable using the bath of the $2^{nd}$ embodiment. The Cu deposition has a purity more than approximately 99%, very close to 100%.

The concentration of the deposited Cu is preferably between 99.0% and 99.9%.

3rd Embodiment

The 3rd embodiment using a Electroless Cu—Co—P Solution. Co is a better alternative than Ni. The Cu deposited is about ~99.9%. The resistance is very low between about 2.6 and 2.7 μOhm-cm.

TABLE

3rd bath composition.

| Chemical | low limit | tgt | high limit |
|---|---|---|---|
| Copper sulphate | 23.2 | 24 mM | 24.8 |
| Mediator Cobalt sulphate | 5 | 10.0 mM | 15 |
| chelting agent Sodium citrate | 50 | 52 mM | 54 |
| Sodium hypophosphite | 90 | 100 mM | 110 |
| Chelting agent Boric acid | 135 | 150 mM | 165 |
| pH | 9.1 | 9.2 | 9.3 |
| Temp | 88 | 90° C. | 92 |

Figure 2:
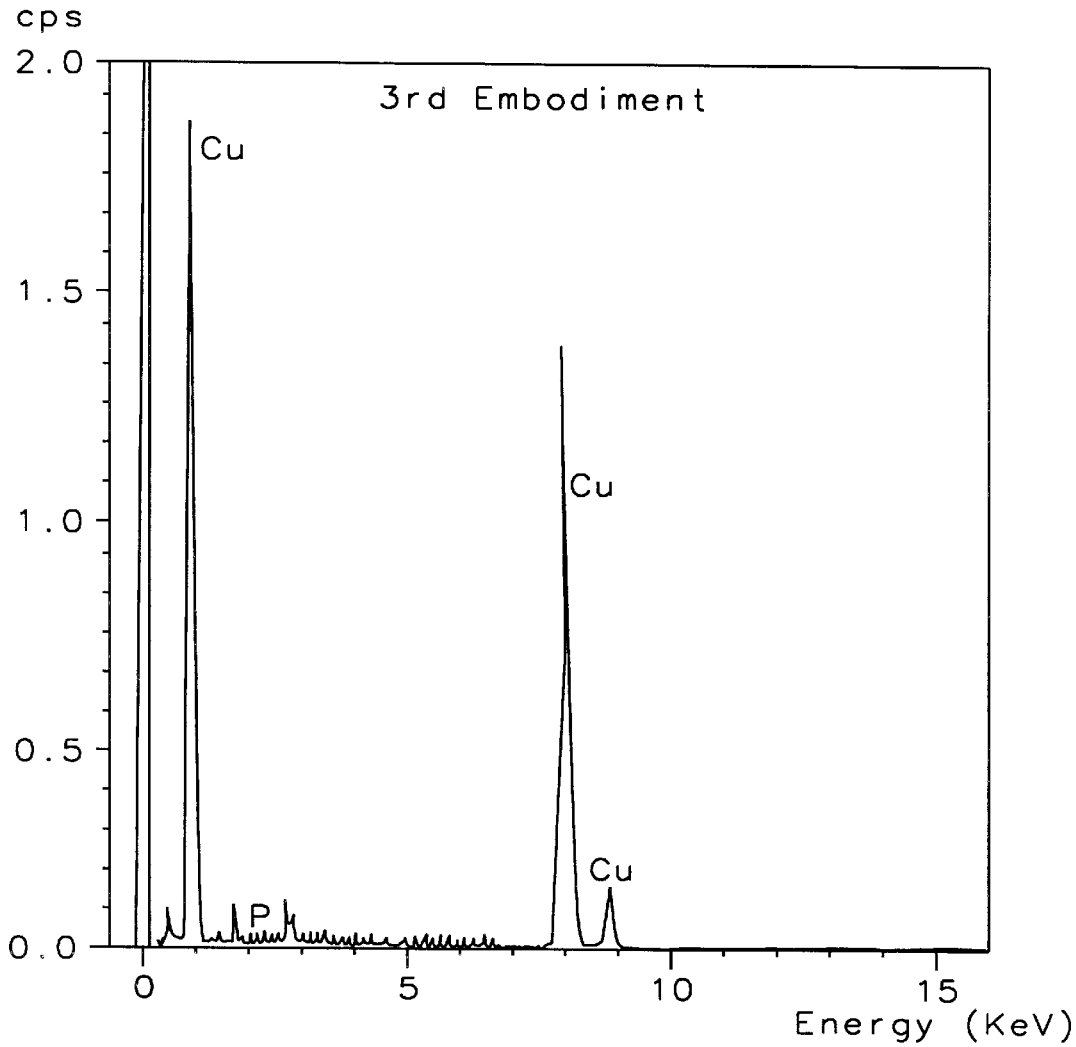
FIG. 2 is a spectrum analysis of a copper deposition formed using the 3rd embodiment's electroless deposition of the invention.

FIG. 2 shows a Spectrum analysis of the copper deposited using the 3rd embodiment of the invention. Below are the conditions of the deposition.

| Cu—Co—P (4/2/97 09:24) | |
|---|---|
| Cobalt Sulphate | 10 mM |
| Copper Sulphate | 24 mM |
| Sodium Citrate | 5.2 mM |
| Sodium Hypophosphite | 100 mM |
| Boric acid | l50 mm |
| pH | 9.2 |
| Temp | 90° C. |

FIG. 2 show the high purity achievable using the bath of the 3rd embodiment. FIG. 2 shows the low P and Co concentrations. The concentration of the deposited Cu is between 99.0% and 99.9%.

4th Embodiment

The 4th bath uses a Fe mediator. The deposition surface must be pretreated, preferably with a Pd activation solution, because Fe is in the solution and is difficult to deposit.

Electroless Cu—Fe—P Solution 4th bath

| Chemicals | low limit | target | High limit |
|---|---|---|---|
| Copper sulphate | 24 | 25 g | 26 |
| mediator Ferrous sulphate | 1.8 | 2 g/L | 2.2 |
| chelating agents Ammonium sulphate | 35 | 40 g/L | 45 |
| chelating agents Sodium citrate | 25 | 30 g/L | 35 |
| Sodium hypophosphite | 38 | 40 gL | 42 |
| pH | 8.0 | 8.1 | 8.2 |
| Temp | 78 | 80° C. | 82 |

The concentration of the deposited Cu is between 99.0% and 99.9%.

It should be recognized that many publications describe the details of common techniques used in the fabrication process of integrated circuit components. Those techniques can be generally employed in the fabrication of the structure of the present invention. Moreover, the individual steps of such a process can be performed using commercially available integrated circuit fabrication machines. As specifically necessary to than understanding of the present invention, exemplary technical data are set forth based upon current technology. Future developments in the art may call for appropriate adjustments as would be obvious to one skilled in the art.

While the invention has been particularly shown and described with reference to the preferred embodiments thereof, it will be understood by those skilled in the art that various changes in form and details may be made without departing from the spirit and scope of the invention.

What is claimed is:

1. A method for electrolessly depositing Cu on a semiconductor chip, the method comprising:

electrolessly depositing a Cu alloy to form a copper deposition on a substrate of a semiconductor chip; said copper deposition has a composition of Cu between 94 and 96 wt %, Ni between 2 and 3 wt % and P between 2 and 3 wt % and a resistance between about 3.0 to 3.2 micro-ohm-cm;

said copper deposition is deposited on a surface of a material selected from the group consisting of polysilicon, Al and Ti; and said surface is activated by Pd—containing activating solution; and said copper deposition forms a copper interconnect in a hole having an aspect ratio oreater than 2.7 to 1;

the electrolessly deposition using an electroless bath comprising:

a) Water, b) a soluble source of metal ions of Copper sulfate at a concentration between 23.2 and 24.8 mM;

c) a first complexing agent for at least said metal ions; said first complexing agent is Sodium citrate at a concentration between 50 and 54 mM;

d) a soluble source of mediator ions, different from said metal ions; said mediator ions are Nickel sulfate at concentration between 1.95 and 2.05 mM;

e) a Sodium hypophosphite concentration between 140 and 160 mM;

f) a pH, maintained with NaOH, between 9.1 and 9.3;

g) at a Temperature between 64 and 66° C.

2. The method of claim 1 wherein said copper deposition has a thickness in a range of between about 8000 and 20,000 Å.

3. A method for electrolessly depositing Cu on a semiconductor chip; comprising the steps of:

electrolessly depositing a Cu alloy to form a copper deposition on a substrate of a semiconductor chip; said copper deposition has a composition of Cu between about 99 and 99.9 wt %;

said copper deposition is deposited on a surface of a material selected from the group consisting of polysilicon, Al and Ti; and said surface is activated by Pd—containing activating solution; and said copper deposition forms a copper interconnect in a hole having an aspect ratio greater than 2.7 to 1;

the electrolessly deposition using an electroless bath comprising:

a) Water, b) a soluble source of metal ions of Copper sulfate at a concentration between 23.2 and 24.8 mM;

c) a soluble source of mediator ions, different from said metal ions; said mediator ions are palladium sulfate at concentration between 0.012 and 0.013 mM;

d) Sodium hypophosphite at a concentration between 90 and 110 mM;

e) boric acid at a concentration between about 135 mM and 165 mM;

f) Tetramethylethylenediamine at a concentration between about 40 and 60 mM;

g) a pH, maintained with NaOH, between 9.1 and 9.3;

h) at a Temperature between 64 and 66° C.

4. The method of claim 3 wherein said copper deposition has a thickness in a range of between about 8000 and 20,000 Å.

5. A method for electrolessly depositing Cu on a semiconductor chip; comprising:

electrolessly depositing a Cu alloy to form a copper deposition on a substrate of a semiconductor chip; said copper deposition has a composition of Cu between 99.0 and 99.9 wt %;

said copper deposition is deposited on a surface of a material selected from the group consisting of polysilicon, Al and Ti; and said surface is activated by Pd—containing activating solution; and said copper deposition forms a copper interconnect in a hole having an aspect ratio greater than 2.7 to 1;

the electroless deposition using an electroless bath comprising:

a) water;

b) copper sulphate at a concentration between about 23.2 mM and 24.8 mM;

c) a mediator of Cobalt sulphate at a concentration between 5 mM and 15 mM;

d) a chelting agent of Sodium citrate at a concentration between about 50 mM and 54 mM;

e) Sodium hypophosphite at a concentration between about 90 mM and 110 mM;

f) Boric acid at a concentration between about 135 mM and 165 mM;

g) a pH, maintained with NaOH, between 9.1 and 9.3;

h) at a Temperature between 88 and 90° C.

6. The method of claim 3 wherein said copper deposition has a thickness in a range of between about 8000 and 20,000 Å.

7. A method for electrolessly depositing Cu on a semiconductor chip using a Cu—Fe—P bath; the method comprising:

electrolessly depositing a Cu alloy to form a copper deposition on a substrate of a semiconductor chip; said copper deposition forms a copper interconnect in a hole having by activating a surface upon which said copper deposition will be formed by using a Pd—containing activating solution;

said copper deposition forms a copper interconnect in a hole having an aspect ratio greater than 2.7 to 1; and said copper deposition has a composition of Cu between 99.0 and 99.9 wt % the electroless deposition using an electroless bath comprising:

a) Water, b) a soluble source of metal ions of Copper sulfate concentration between 24 g/l and 26 g/l;

c) a soluble source of mediator ions, different from said metal ions; said mediator ions are mediator at a concentration between about Ferrous sulphate 1.8 g/L and 2.2 g/l;

d) Ammonium sulphate at a concentration between about 35 and 45 g/l;

e) Sodium citrate at a concentration between about 25 g/L and 35 g/l;

f) Sodium hypophosphite at a concentration between about 38 g/L and 42 g/L;

g) a pH, maintained with NaOH, between about 8.0 and 8.2;

h) a Temperature between 78° C. and 82° C.

* * * * *